US007944334B2

(12) United States Patent
Woods

(10) Patent No.: US 7,944,334 B2
(45) Date of Patent: May 17, 2011

(54) TAMPER-RESISTANT ALARM SWITCH ASSEMBLY

(75) Inventor: Randall Woods, Sun Lakes, AZ (US)

(73) Assignee: Magnasphere Corp., Waukesha, WI (US)

( * ) Notice: Subject to any disclaimer, the term of this patent is extended or adjusted under 35 U.S.C. 154(b) by 298 days.

(21) Appl. No.: 12/172,788

(22) Filed: Jul. 14, 2008

(65) Prior Publication Data

US 2010/0006408 A1 Jan. 14, 2010

(51) Int. Cl.
*H01H 9/02* (2006.01)

(52) U.S. Cl. ..... 335/205; 335/206; 335/207; 340/545.1; 340/545.7; 340/547

(58) Field of Classification Search ..... 335/205–207, 335/151–154; 340/545.1–545.9
See application file for complete search history.

(56) References Cited

U.S. PATENT DOCUMENTS

| | | | | |
|---|---|---|---|---|
| 5,332,992 | A | 7/1994 | Woods | |
| 5,633,626 | A | 5/1997 | Cawthorne | |
| 5,668,533 | A * | 9/1997 | Jackson et al. | 340/547 |
| 5,929,731 | A * | 7/1999 | Jackson, Jr. | 335/207 |
| 5,977,873 | A | 11/1999 | Woods | |
| 6,506,987 | B1 | 1/2003 | Woods | |
| 6,603,378 | B1 | 8/2003 | Collins | |
| 6,803,845 | B2 | 10/2004 | Woods | |
| 6,963,281 | B2 * | 11/2005 | Buckley | 340/547 |
| 7,023,308 | B2 | 4/2006 | Woods | |
| 7,187,259 | B1 | 3/2007 | Habboosh | |
| 7,218,194 | B2 | 5/2007 | Habboosh | |
| 7,248,136 | B2 | 7/2007 | Habboosh | |
| 7,291,794 | B2 | 11/2007 | Woods | |

* cited by examiner

*Primary Examiner* — Ramon M Barrera
(74) *Attorney, Agent, or Firm* — Hovey Williams LLP

(57) ABSTRACT

Tamper-resistant alarm switch assemblies (22, 100, 124, 148) are provided which include a first movement-sensing switch (24) and a second tamper-sensing switch assembly (25) including a switchable component (26) and an actuating component (74, 136, 166), mounted on a member (30) and each being switchable between respective first and second movement-sensing and tamper-sensing switch states in response to relative movement between first and second members (30, 32), and relative shifting between the switch (26) and actuating component (74, 136, 166). Mounting structure (28, 106, 138) is provided to attach the first switch (24) and second switch assembly (25) to the member (30) in a normal operating position wherein the first switch (24) will sense relative movement between the first and second members (30, 32), with relative shifting between the switchable component (26) and the actuating component (74, 136, 166) in the event of an attempted detachment of at least one of the components (26, 74, 136, 166) of the tamper switch assembly (25), or the first switch (24), or both thereof, from the member (30).

33 Claims, 5 Drawing Sheets

TAMPER-RESISTANT ALARM SWITCH ASSEMBLY

BACKGROUND OF THE INVENTION

1. Field of the Invention

The present invention is broadly concerned with improved tamper-resistant switch assemblies operable to detect relative movement between first and second relatively shiftable members while providing a reliable anti-tampering feature. More particularly, the invention is concerned with such switch assemblies which are specifically designed for use in high security contexts, while permitting interior mounting of the components thereof within standard hollow door frames or the like.

2. Description of the Prior Art

In recent years the Magnasphere Corp. of Brookfield, Wis. has introduced a series of innovative and highly reliable switch products useful as a part of alarm systems or as proximity sensors. Such Magnasphere switches in general include a hollow housing typically (though not necessarily) formed of electrically conductive material and with one or more conductive electrodes extending into the housing. A shiftable conductive ball is also located within the housing. The ball moves under the influence of magnetic conditions between respective switch states, usually from a position of simultaneous contact with the switch electrodes to a position out of such simultaneous contact. Such switches are referred to herein as "magnetic ball" switches. U.S. Pat. Nos. 7,291,794; 5,977,873; 6,506,987; 6,603,378; 6,803,845; 7,023,308; and 5,332,992 illustrate various types of magnetic ball switches.

Harco Laboratories, Inc. of Bramford, Conn. has also commercialized a series of high-security switch products using multiple Magnasphere switches. See, e.g., U.S. Pat. Nos. 7,187,259; 7,218,194; and 7,248,136. High security switches of this type are almost always mounted externally, e.g., external assemblies are mounted in adjacent relationship on a door and door frame. These external switches may also include anti-tamper switch components, see U.S. Pat. No. 5,633,626.

However, externally mounted high security switches tend to be very unsightly and make easy access for potential tamperers. A particular problem in this regard is that putatively loyal employees may during business hours or other time when an alarm system is not operational attempt to tamper with inactive external switch components, so as to permit unauthorized entry during non-business hours when the alarm system is supposed to provide security.

Accordingly, there is a real unsatisfied need in the art for improved high security and other alarm switch assemblies which can if desired by mounted internally within hollow structures such as metallic door frames, and which provide reliable motion sensing and tamper sensing as required.

SUMMARY OF THE INVENTION

The present invention overcomes the problems outlined above and provides improved tamper-resistant switch assemblies operable to detect relative movement between first and second members, while also providing a secure and reliable anti-tamper feature. The switch assemblies of the invention are particularly suited to be a part of high security switches which may be mounted internally within the door frame or the like. Broadly speaking, the switch assemblies include a first movement-sensing switch mounted on one of the members and operable to switch between first and second separate movement-sensing states in response to relative movement between the first and second members, together with a second tamper switch assembly mounted on the one member and including a switchable component and an actuating component. The switchable component and actuating component are relatively shiftable, and the switchable component is switchable between first and second tamper-sensing states in response to the relative shifting between the switchable and actuating components. Finally, the overall assemblies include mounting structure operable to attach the first switch and the second switches to the one member in a normal operating position wherein the first switch will sense relative movement between the first and second members, and to cause relative shifting between the switchable component and the actuating component of the tamper-sensing switch assembly, in the event of attempted detachment of at least one of the components of the second switch assembly, the first switch, or both thereof, from the normal operating position.

Preferably, both the movement-sensing and the tamper-sensing switches are magnetically actuatable switches operable to switch between first and second separate switch states in response to a change in magnetic field conditions adjacent the switches. Especially preferred are magnetic ball or Magnasphere switches having a housing, at least one elongated, electrically conductive switch element extending into the housing, a shiftable body located within the housing and formed of electrically conductive material, and a second electrically conductive switch element, the body being shiftable within the housing between a first position wherein the body is in electrical contact with both the first and second switch elements, and a second position wherein the body is not in contact with both the first and second switch elements.

The mounting structure may be variable, depending upon the type of mounting member being used, and whether the switch assemblies are being retrofitted as replacements. For example, in certain cases the mounting structure comprises a first plate supporting the first movement-sensing switch, a second plate supporting one of the tamper-sensing switch assembly components, wherein the first and second plates secured to the one member. Typically threaded fasteners are used to attach the first and second plates to the one member. In such embodiments, the first and second switches are located within the first member and are cooperatively configured such that detachment of the first or second plate, or both thereof, causes alarm-triggering relative shifting movement between the switchable component and the actuating component of the tamper switch.

DETAILED DESCRIPTION OF THE PREFERRED EMBODIMENT

Figure 1:
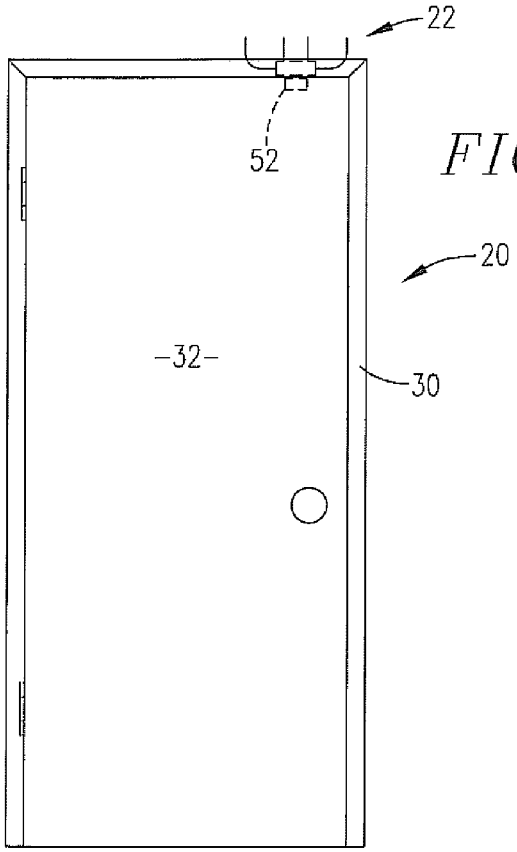
FIG. 1 is an elevational view of a door mounted within a door frame and wherein the door and door frame are equipped with an alarm switch assembly in accordance with the invention.

Turning now to the drawings, a protected door and door frame assembly 20 illustrated in FIG. 1, with a tamper-resistant alarm switch assembly 22 in accordance with the invention operatively mounted on the door/door frame assembly 20. Although not shown, it will be understood that the assembly 20 is operatively coupled with an alarm controller and alarm bell or other perceptible alarm-indicating device. A complete system of this type is illustrated in U.S. Pat. No. 7,291,794 (FIG. 3), and such system disclosure is incorporated by reference herein.

The assembly 22 includes a first movement-sensing switch 24 (FIG. 3), as well as a second tamper-sensing switch assembly 25 including a switchable component in the form of a switch 26. Mounting structure 28 is also provided for securing the switches 24 and 26 onto the door or door frame of assembly 20. Preferably, the switches 24, 26 are mounted on a door frame 30 such that the operative components are internally located within the confines of the door frame, with other components of the overall assembly 22 mounted on door 32, as will be explained. In use, the assembly 22 is designed to initiate an alarm in the event of an unauthorized opening of door 32 when the alarm system is armed. Moreover, the assembly 22 is especially designed to provide a secure and reliable anti-tamper function when the door 32 is properly open, for example during normal business hours where the switch 24 is disarmed, thus exposing the assembly 22 to tampering.

Figure 3:
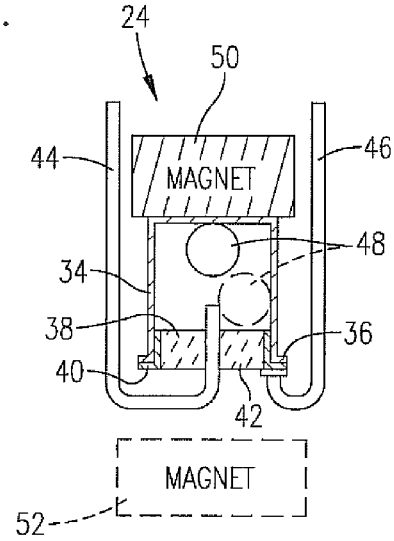
FIG. 3 is a schematic view illustrating the configuration of a preferred movement-sensing switch in accordance with the invention, and illustrating the two switch states thereof.

In greater detail, the preferred movement-sensing switch 24 is a magnetic ball switch of the type commercialized by Magnasphere, Inc. of Brookfield, Wis. Such an exemplary switch is illustrated in FIG. 3 and includes a metallic can-like housing 34 presenting a terminal flange 36. The open end of housing 34 is closed by a cover 38 comprising a peripheral metallic wall 40 supporting a non-metallic plug 42. An elongated, electrically conductive electrode 44 extends through plug 42 as shown, into the confines of housing 34. A second electrode 46 is electrically coupled with metallic housing 34. The switch 24 further includes a shiftable ball 48 located within housing 34. Preferably, the ball is formed of magnetic material such as a ferromagnetic metal, or comprises a non-metallic ball coated with such a ferromagnetic material. A biasing magnet 50 is located adjacent the end of housing 34 remote from plug 42 and is magnetically coupled with ball 48. As further shown in FIG. 3, the ball 48 may assume a first position (shown in full lines), corresponding to a first switch state, wherein the ball is magnetically biased towards the adjacent wall of housing 34, and is out of contact with electrode 44 (and thus out of simultaneous contact with both electrodes 44 and housing 34). The ball 48 may alternately be shifted to a second position (shown in phantom), corresponding to a second switch state, wherein the ball is magnetically biased to a position in simultaneous contact with electrode 44 and the wall of housing 34, the latter being electrically connected with electrode 46. The preferred switch 24 also includes a separate operating magnet 52 which in the illustrated embodiment is mounted on door 32.

Again referring to FIG. 1, it will be appreciated that when door 32 is closed operating magnet 52 is closely adjacent the switch 24. As such, the magnetic field conditions adjacent the switch 24 induced by magnet 52 serve to move the ball 48 to the second position described above. However, in the event that the door 32 is opened while the assembly 22 is active, the magnet 52 moves away from the switch 24, thereby allowing bias magnet 50 to magnetically shift ball 48 to the first position. This change in switch state is read by the alarm controller, and an alarm is actuated.

Figure 4:
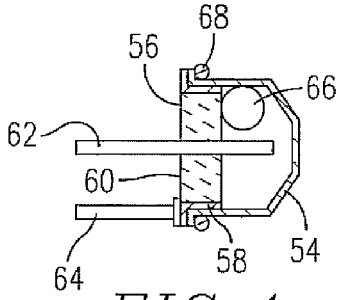
FIG. 4 is a schematic view illustrating the configuration of a preferred switchable component forming a part of a tamper switch assembly in accordance with the invention.

The preferred tamper-sensing switch 26 is illustrated in FIG. 4 and is likewise of the magnetic ball variety. Specifically, the switch 26 includes a metallic housing 54, and a cover 56 made up of peripheral wall 58 and non-conductive central plug 60. A first electrode 62 extends through plug 60 and into the confines of housing 54. A second electrode 64 is operatively secured to conductive housing 54. A shiftable ball 66 is located within housing 54 and is shiftable between a first position (shown in full lines) corresponding to a first switch state, which is out of simultaneous contact with the electrode 62 and housing 54. A magnetic biasing ring 68 is located about housing 54 and serves to bias ball 66 to the FIG. 4 position. In the event that the switch 26 experiences magnetic field conditions of sufficient magnitude, the ball 66 is magnetically shifted to a second position in simultaneous contact with electrode 62 and housing 54.

Figure 2:
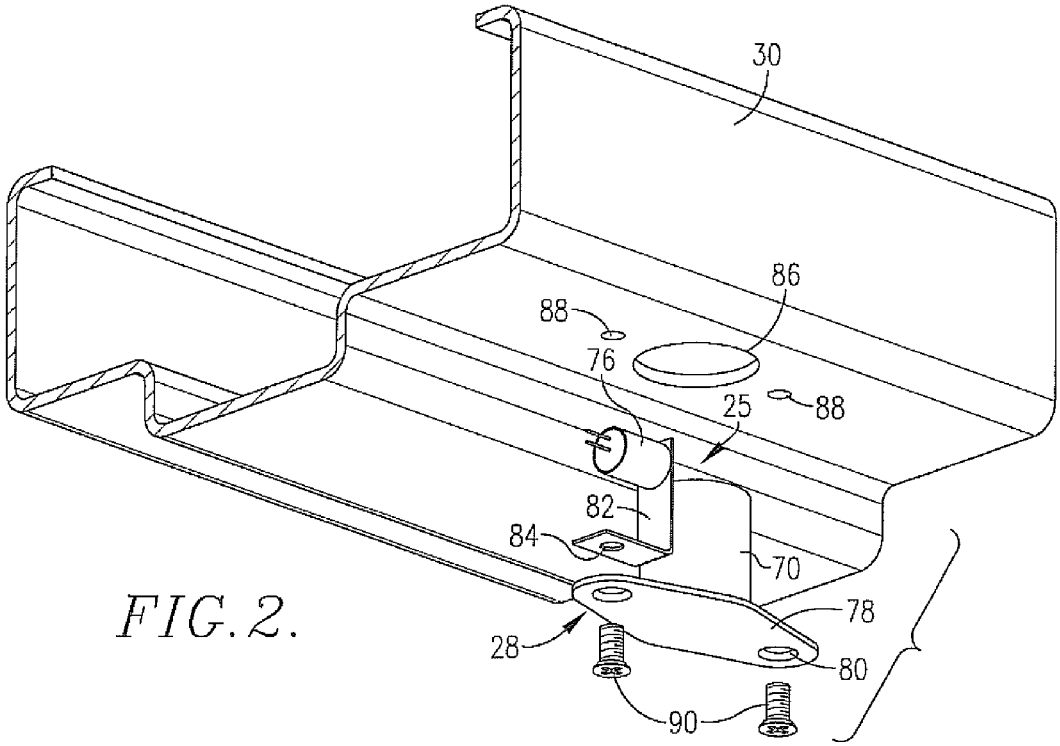
FIG. 2 is a fragmentary, perspective, exploded view illustrating a portion of the door frame of FIG. 1, and with a first tamper-resistant alarm switch assembly embodiment.
Figure 5:
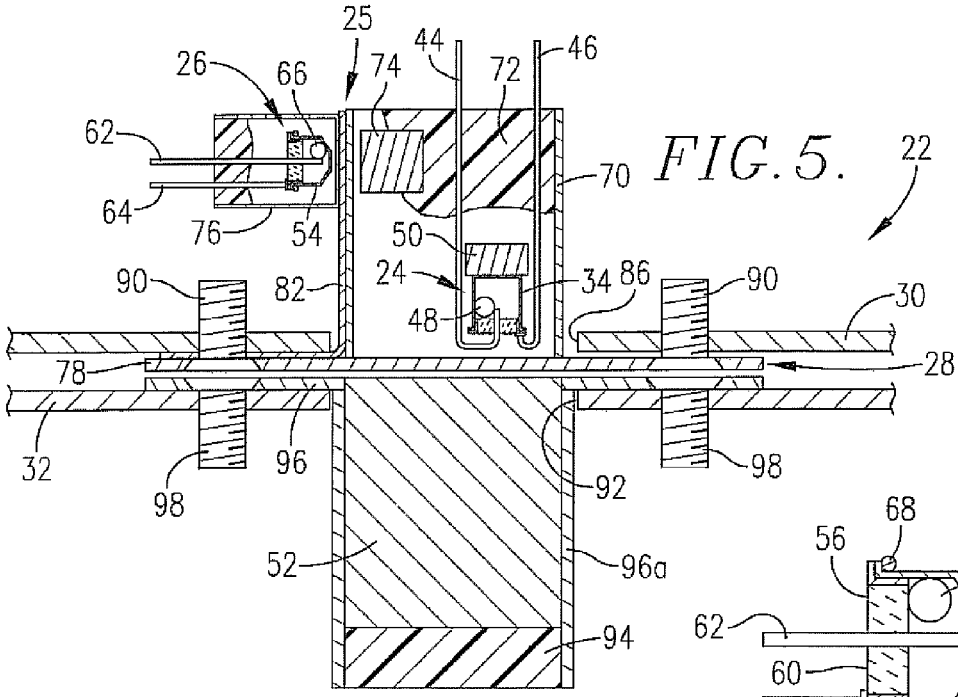
FIG. 5 is a fragmentary vertical sectional view with parts broken away of the door and door frame-mounted alarm assembly of FIG. 1, shown with the door in its closed position and the movement-sensing switch in its first state.

Attention is next directed to FIGS. 2 and 5, which illustrate in detail the assembly 22 and the preferred mounting thereof to door frame 30. The switch 24 is located within a circular housing 70 which is filled with an epoxy or other suitable encapsulant 72 (the Figures illustrate only a portion of the encapsulant to facilitate an understanding of the invention). The electrodes 44 and 46 extend out of housing 70 for attachment to the overall alarm system. In addition, it will be observed that a tamper switch operating magnet 74 forming a part of tamper switch assembly 25 is also encased within encapsulant 72 in spaced relationship to the switch 24. The tamper-sensing switch 26 is likewise located within a separate encapsulant-filled housing 76, with the electrodes 62 and 64 extending out of the housing 76 for connection to the alarm system.

The switches 24 and 26 must be located in proper relative positions in order to operate effectively. Accordingly, the mounting structure 28 is especially designed for this purpose. The structure 28 includes a first apertured plate 78 supporting housing 70 and having a pair of spaced apart fastener-receiving openings 80. Further, the structure 28 includes a second, generally L-shaped plate 82 supporting housing 76 and having a fastener-receiving opening 84. In order to mount the assembly 22 within door frame 30, a previously existing (in the case of a retrofit) or freshly drilled hole 86 is provided in door frame 30, along with threaded fastener bores 88; as depicted, the hole 86 is closely dimensioned relative to the housing 70 so as to have only a minimum of side play. The structure 28 is completed by provision of two mounting screws 90.

In order to install assembly 22 within door frame 30, the upright leg of second plate 82 and attached housing 76 are passed through hole 86, followed by insertion of the housing 70. The opening 84 of plate 82 is then moved in registry with one of the openings 80 of plate 78, and these aligned openings are located in registry with the adjacent bore 88. Such positioning also serves to align the other opening 80 with the remaining bore 88. Next, the screws 90 are passed through the openings and are threaded into the bores 88 in order to complete the construction. As installed, it will be seen that the switch 24 is located adjacent the bottom of housing 70, whereas magnet 74 is located near the top of the housing and proximal to the sidewall thereof. Moreover, the switch 26 is located in close relationship to the magnet 74, owing to the configuration of plate 82.

The door 32 is equipped with a magnet 52 as previously described. In detail, the magnet 52 is positioned within an opening 92 of door 32 with a lower epoxy or similar plug 94. The magnet 52 plug 94 are attached to door 30 by means of apertured plate 96 having a depending tubular section 96*a*, with the plate 96 secured to the upper edge of door 32 by means of screws 98.

FIG. 5 illustrates the door 32 closed against door frame 30, in the normal security condition of assembly 22. As seen, the magnet 52 is directly below switch 24, and the influence of the magnet 52 serves to move switch ball 48 to the second position thereof with the ball is in simultaneous contact with electrode 44 and housing 34. At the same time, the proximity of magnet 74 and tamper-sensing switch 26 causes the switch ball 66 of the latter to be moved to the second position thereof in simultaneous contact with electrode 62 and housing 54.

Figure 6:
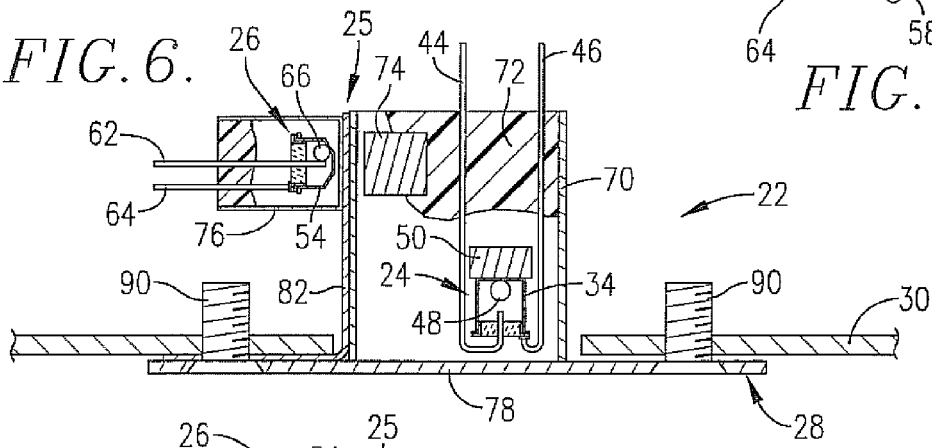
FIG. 6 is a view similar to that of FIG. 5, but illustrating the door in its opened positioned and with the movement-sensing switch in its second state.

If the door 32 is opened without disarming the alarm system, the movement of magnet 52 away from switch 24 allows biasing magnet 50 to move ball 48 to its first position as illustrated in FIG. 6. This change in switch state is then read by the alarm system and an alarm is triggered. It will be appreciated that during this operational sequence the tamper switch 26 does not come in to play.

Figure 7:
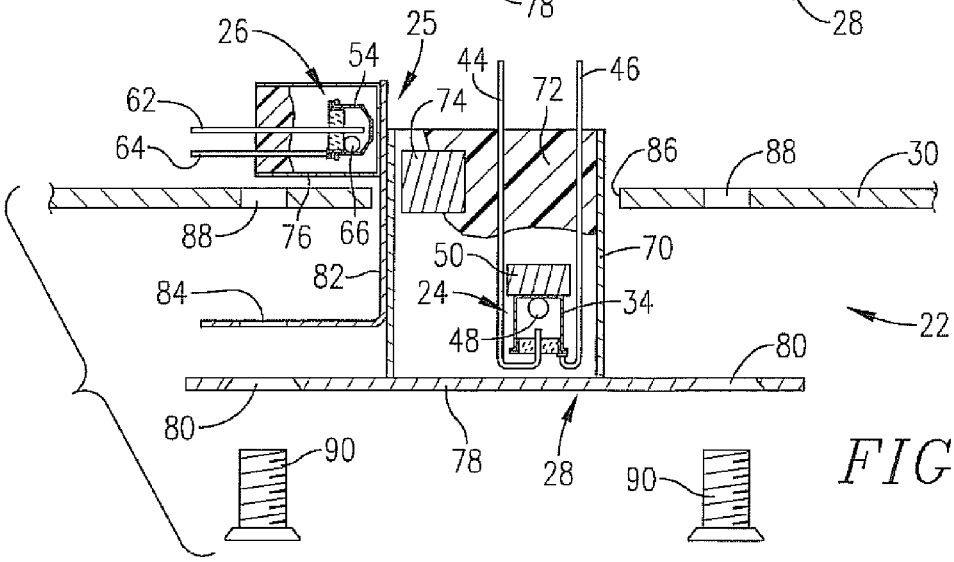
FIG. 7 is a view similar to that of FIG. 6, but illustrating operation of the tamper switch assembly in the event of an attempt to detach the switch assembly from the door frame.
Figure 8:
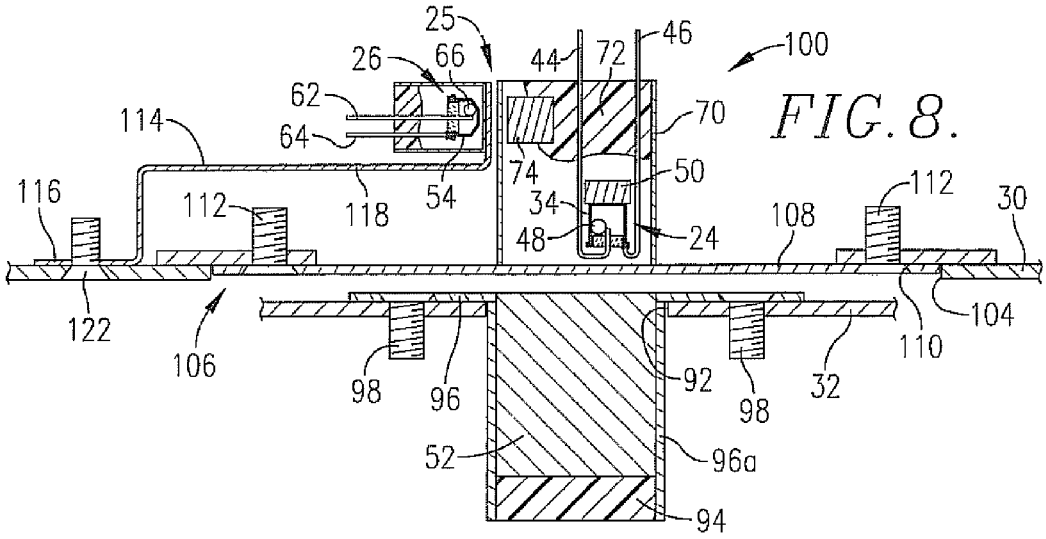
FIG. 8 is a view similar to that of FIG. 6, but illustrating a second alarm switch assembly embodiment, wherein the door is closed and the movement-sensing switch thereof is in its first state.
Figure 9:
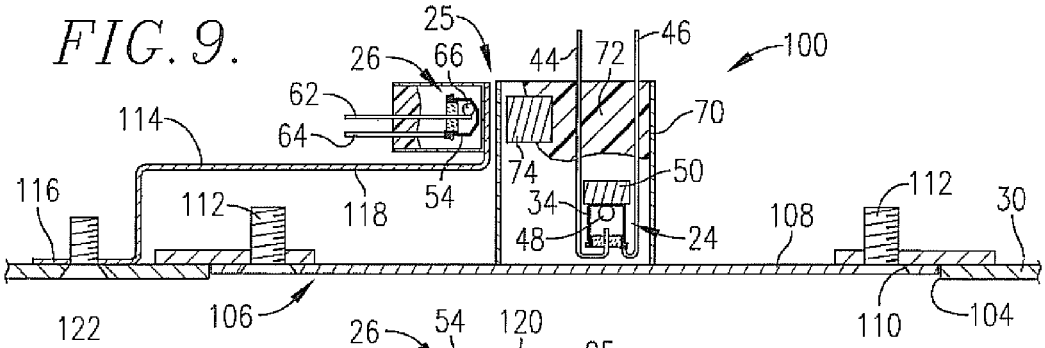
FIG. 9 is a view similar to that of FIG. 8, but illustrating the door in its open position and with the movement-sensing switch in its second state.
Figure 10:
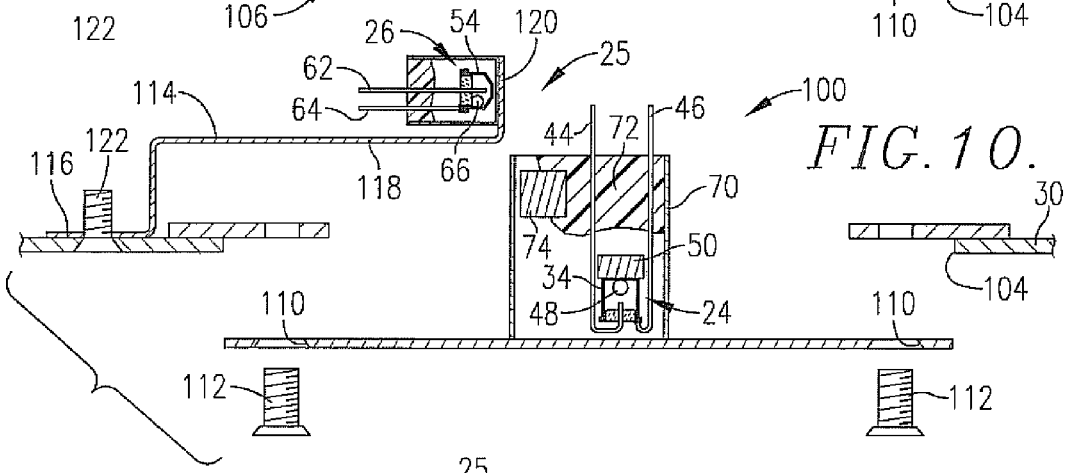
FIG. 10 is a view similar to that of FIG. 9, but illustrating operation of the tamper switch assembly in the event of an attempt to detach the movement-sensing switch from the door frame.
Figure 11:
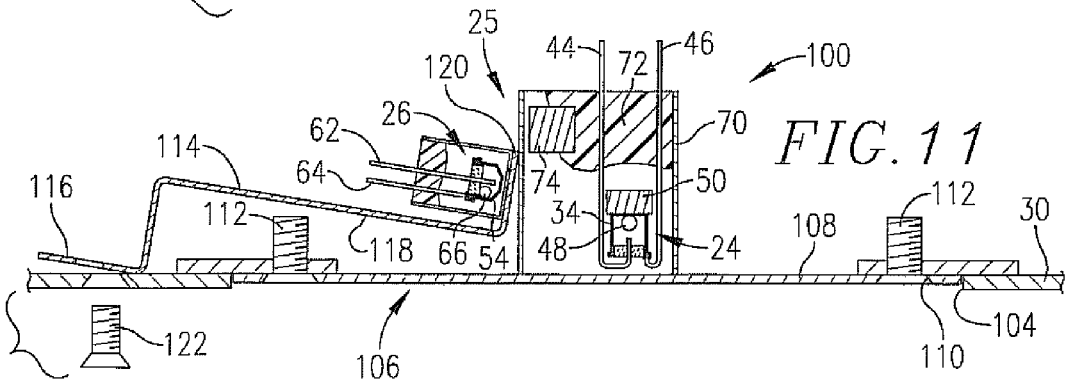
FIG. 11 is a view similar to that of FIG. 10, but illustrating the operation of the tamper switch assembly in the event of an attempt to detach the tamper switch assembly from the door frame.

However, in high security situations a tamper-resistant alarm switch assembly is desirable in order to prevent tampering with the switch assembly when the door 32 is open during normal business hours or the like. FIG. 7 illustrates the operation of assembly 22 in such an event. Specifically, in order to disarm or otherwise deactivate the assembly 22, the screws 90 would be removed as shown, and the plates 78 and 82 would be grasped and pulled away from door frame 30. This immediately creates a situation where the tamper-sensing switch 26 is moved away from operating magnet 74. This may occur owing to slippage between the housing 70 and plate 82, or when the housing 76 engages the inner surface of door frame 30. In any case, such relative movement between magnet 74 and tamper-sensing switch 26 immediately causes the switch ball 66 to move under the influence of biasing ring 68 to the first position thereof wherein the ball 66 is out of simultaneous contact with the electrode 62 and housing 54. In this condition the alarm system is actuated. In this connection, it will be appreciated that in this tamper-sensing mode the movement-sensing switch 24 would normally be deactivated, because of the fact that the premises would be normally open, and door 32 could thus be opened and closed without triggering the alarm system. However, in the tamper-sensing mode, the tamper-sensing switch 26 would be armed to trigger an alarm if the assembly 22 is subjected to tampering.

FIGS. 8-11 illustrate another alarm switch assembly 100 which is designed for use with a door frame 30 having a relatively large, typically rectangular opening 104 therein. Such an opening 104 would commonly be found with certain types of conventional alarm switch assemblies currently in use. The assembly 100 and some of the remaining embodiments described herein preferably use the same door frame mounted movement-sensing switch 24 and associated operating magnet 52 within door 32, and the same tamper-sensing switch assembly 25 including switch 26 and proximal operating magnet 74. Accordingly, such like parts are identically numbered.

The assembly 100 makes use of mounting structure 106 which takes into account the rectangular opening 104. In particular, the mounting structure 106 includes a relatively large first plate 108 having lateral opening 110 therein and which supports the housing 70, much in the manner of plate 78. The first plate 108 is secured to door frame 30 by means of screws 112 extending through openings 110 and into threaded bores provided in door frame 30. The structure 106 further includes a somewhat Z-shaped bracket or second plate 114 which includes a bored connection leg 116, a lateral stretch 118, and an upright leg 120 supporting housing 76. The second plate 114 is secured in place by means of a screw 122 extending through door frame 30 and into connection leg 116.

The normal operating condition of assembly 100 (FIG. 8) is the same of that for assembly 22, such that when door 32 is opened, the movement-sensing switch 24 changes state to actuate an alarm. In the tamper-sensing condition (FIG. 9), detachment of the first plate 108 by removal of the screws 112 causes the attached housing 76 to move out of opening 104, thereby creating a relative movement between operating magnet 74 and tamper-sensing switch 26. This in turn causes the tamper switch ball 66 to be shifted under the influence of biasing ring 68 to the first switch position, with resultant alarm triggering. Alternately, if an attempt is made to tamper with assembly 100 by removing screw 122, the detached second plate 114 tilts or dislodges as illustrated in FIG. 11 to again cause relative movement between magnet 74 and tamper-sensing switch 26, which also triggers the alarm.

Figure 12:
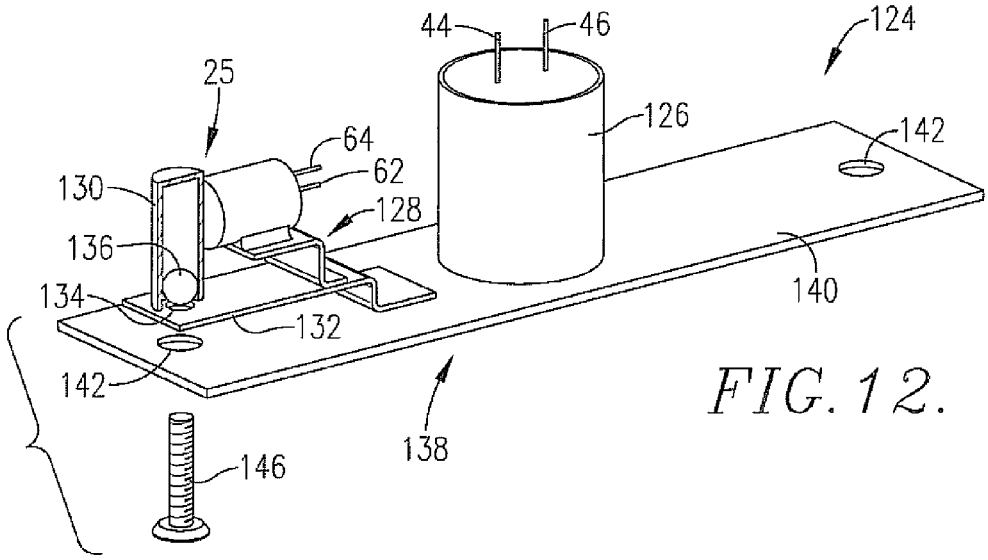
FIG. 12 is a perspective view with parts broken away of a third alarm assembly embodiment in accordance with the invention.
Figure 13:
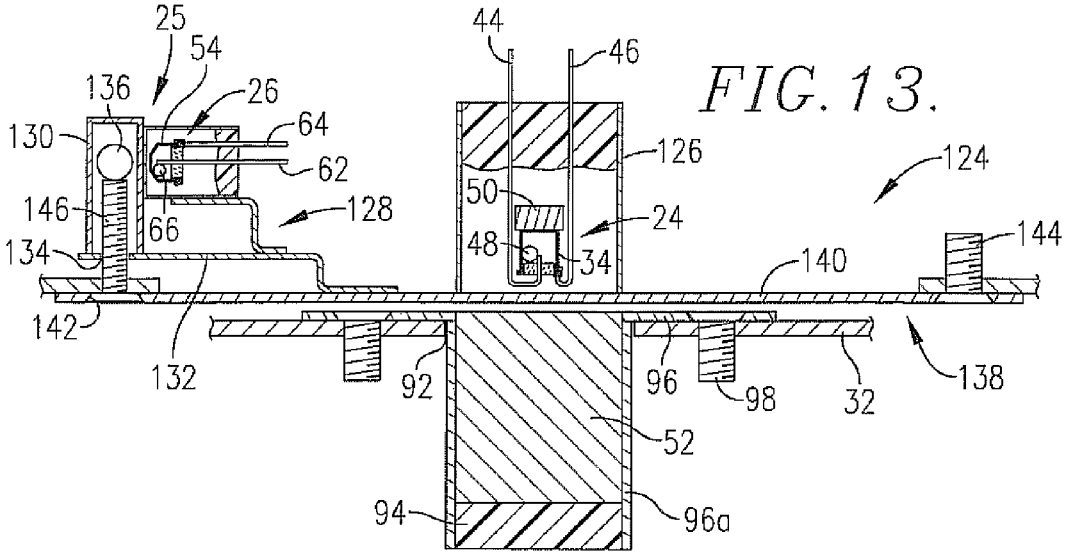
FIG. 13 is a view similar to that of FIG. 6 and illustrating the FIG. 13 embodiment with the door in its closed position and the movement-sensing switch in its first state.
Figure 14:
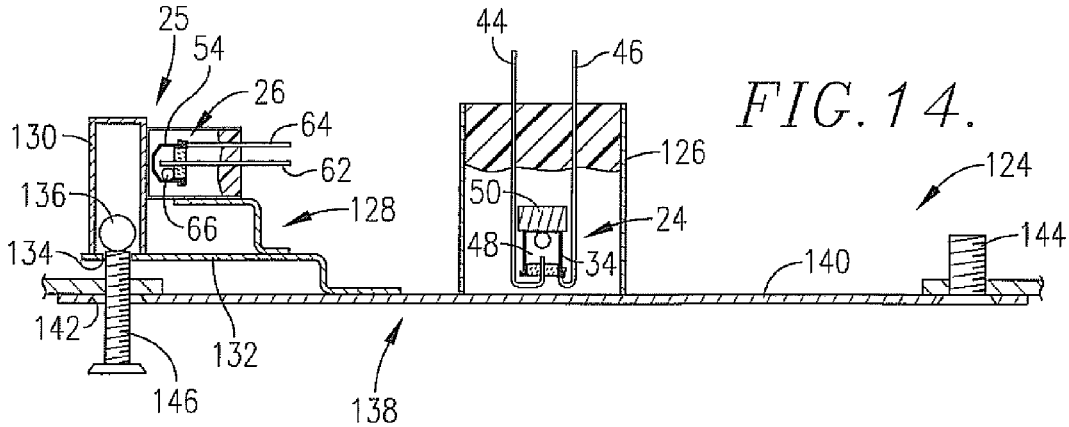
FIG. 14 is a view similar to that of FIG. 13, but depicting the door opened and the movement-sensing switch in its second state.
Figure 17:
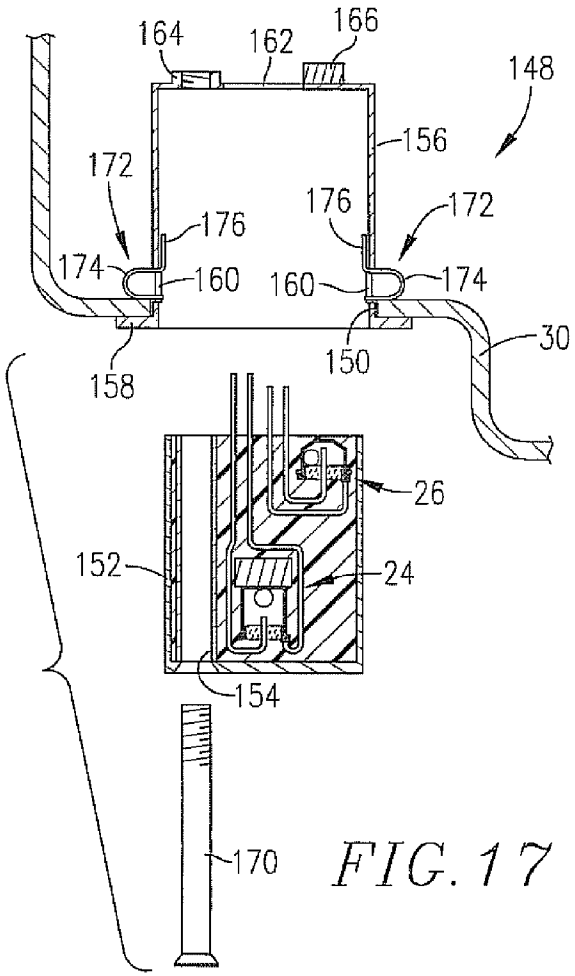
FIG. 17 is a vertical sectional exploded view illustrating the steps involved in construction of the switch assembly of the fourth embodiment.

FIGS. 12-14 depict a still further embodiment of the invention, in the form of an alarm switch assembly 124. The switch 24 is located within an encapsulant-filled housing 126 without provision of an operating magnet for tamper-sensing switch 26. Rather, the tamper-sensing switch 26 is provided with a mount 128 including an upright tubular column 130 supported by a base plate 132, the latter having an opening 134 in registry with the column 130. A magnetic ball 136 is located within column 130 and is vertically moveable therein.

The mounting structure 138 for assembly 124 is in the form of a simple plate 140 supporting housing 126 and base plate 132. Connection openings 142 are provided adjacent the ends of plate 140 with one of such openings in registry with opening 134, and receive and attachment screws 144 and 146. It will be seen that screw 146 is considerably longer than the other screw 144.

FIG. 13 illustrates the normal armed condition of the assembly 124, with the door-mounted magnet 52 directly beneath movement-sensing switch 24. Moreover, the longer screw 146 extends upwardly through openings 142 and 134, and serves to elevate ball 136 to a point closely adjacent the tamper-sensing switch 26. This relative location between the ball 136 and switch 26 serves to maintain tamper switch ball 66 in its second position in simultaneous contact with electrode 62 and housing 54.

In the event of an attempted tamper, the removal of screw 146 (FIG. 14) allows ball 136 to move downwardly within column 130, with result that biasing ring 68 of tamper-sensing switch 26 moves ball 66 to its second position out of simultaneous contact with housing 54 and electrode 62, thereby triggering an alarm.

It will be appreciated that in lieu of screw 146 an unthreaded upright positioning post or element could be used, with separate conventional mounting screws.

Figure 16:
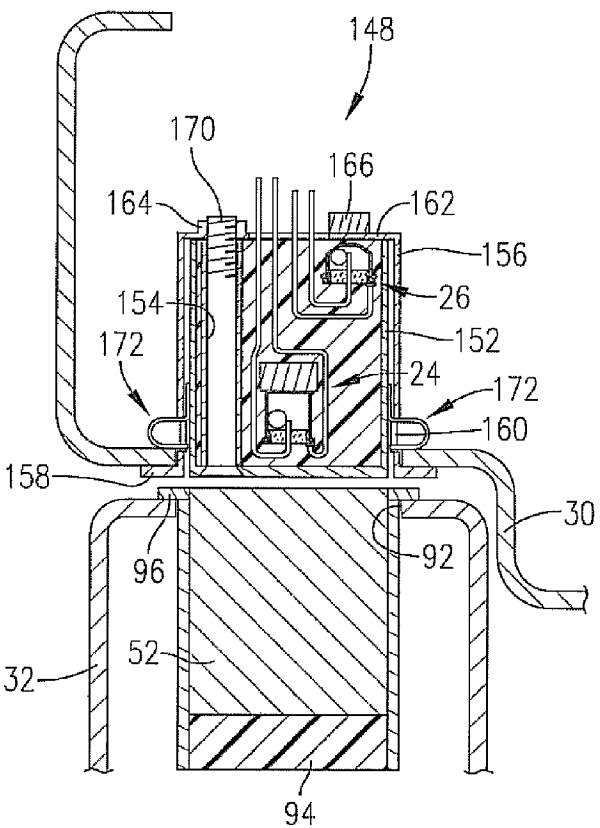
FIG. 16 is a vertical sectional view illustrating the fourth embodiment installed on a door/door frame.
Figure 15:
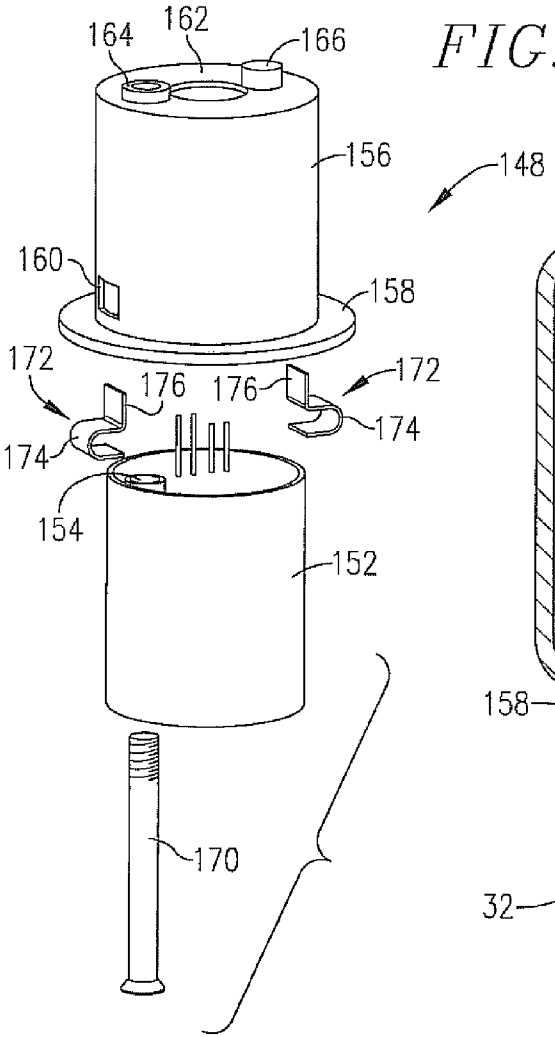
FIG. 15 is an exploded perspective view of components of a fourth alarm switch assembly embodiment.

FIGS. 15 and 16 illustrate another alarm switch assembly 148, which again makes use of the previously described movement-sensing switch 24 and tamper-sensing switch 26. In this configuration, the assembly 148 is designed to fit within a circular opening 150 provided in door frame 30. The switches 24 and 26 are both mounted within a encapsulated-filled housing 152, with the switch 24 adjacent the base of the housing while the switch 26 is located near the upper end thereof. The housing 152 is also equipped with a counter sunk screw passageway 154 extending from the base to the upper end of the housing. The housing 152 fits within a complemental tubular bushing 156 having a lowermost abutment flange 158 and a pair of opposed side slots 160. The top plate 162 of the housing includes a threaded ferrule 164 in alignment with passageway 154, and an operating magnet 166.

The mounting structure for assembly 148 includes the flange 158, a connection screw 170 extending through passageway 154 and threaded into ferrule 164, and a pair of spring clips 172. The latter have a compressible bent section 174 and an upright section 176. In use, the bushing 156 is installed within opening 150, followed by positioning of clips 172 such that sections 174 thereof protrude through slots 160. Next, the housing 152 is inserted into bushing 156, thereby captively retaining the legs 176 of the clips 172 between the outer wall of the housing 152 and the inner wall of bushing 156. The inherent spring qualities of the clips 172 serves to bias the flange 158 upwardly against the surface of door frame 30. The screw 170 is then inserted through bore 154 by threading the end thereof into ferrule 164.

The normal operation of assembly 148 is exactly that as described in connection with the earlier embodiment, it being understood that door-mounted magnet 152 is located directly below movement-sensing switch 24, and that bushing-mounted magnet 166 is directly adjacent the tamper-sensing switch 26. In the event of a tamper attempt wherein screw 170 is removed and housing 152 is removed from bushing 156, the relative shifting of the switch 26 and magnet 166 serves to trigger an alarm.

It will thus be seen that the present invention provides tamper-resistant switch assemblies which retain full functionality during normal alarm operations, but which also have a significant tamper resistance. While the invention has been illustrated in the context of a system for protecting a door, it will be understood that the switch assemblies hereof can be used in a wide variety of situations, such as in the protection of windows or as proximity sensors. In this environment, the switch assemblies would signal the presence of a ferromagnetic body so that if such a body comes into proximity with the switch assemblies, the magnetic attraction is effected and a change in switch state occurs.

It will also be appreciated that the switch assemblies can be reversed, in the sense that the switch assemblies may be mounted on doors, rather than door frames. The same of course would be true in other uses. Further, while in the preferred magnetic ball switches use is made of external biasing and operating magnets, and a corresponding ferromagnetic ball, it is only necessary that these components be fabricated from appropriate materials which make possible the desired magnetic operation. Thus, the switch balls could be made of magnetic material, whereas the external components could be fabricated from a ferromagnetic material such as steel. Broadly speaking, it is only necessary that there be an adequate magnetic attraction or coupling between the switch balls and the associated components outside of the ball housings.

It should also be clear that while magnetic ball switches are preferred, the invention can utilize different types of switches as movement-sensing and/or tamper-sensing switches. Thus, these switches may be individually selected from the group consisting of a reed switch, a Hall effect switch, a micro switch, a magnetic slide switch of the type disclosed in U.S. Pat. No. 5,668,533 fully incorporated by reference herein, or a magnetic ball switch. Again, the only requisite is that a switch be provided which will change state for motion and/or tamper sensing.

I claim:

1. A tamper-resistant switch assembly operable to detect relative movement between first and second members, one of said members having an apertured outer surface and a hollow interior space inboard of said outer surface and in communication with said aperture, said switch assembly comprising:

a first movement-sensing switch located within said hollow interior space of said one member inboard of said outer surface and operable to switch between first and second separate movement-sensing states in response to relative movement between said first and second members;

a second tamper-sensing switch assembly located within said hollow interior space of said one member inboard of said outer surface and including a switchable component and an actuating component, said switchable component and actuating component being relatively shiftable, said switchable component switchable between first and second tamper-sensing states in response to said relative shifting between the switchable and actuating components; and mounting structure operable to support said first switch and second switch assembly within said hollow interior space of said one member and inboard of said outer surface thereof in a normal operating position wherein said first switch will sense said relative movement between said first and second members, and to cause said relative shifting between the switchable component and the actuating component of said tamper switch assembly, in the event of attempted detachment of at least one of the components of said second switch assembly, the first switch, or both thereof, from said normal operating position, said switchable component of said second tamper switch assembly being a magnetically actuatable switch operable to switch between said first and second separate tamper-sensing states in response to a change in magnetic field conditions adjacent said switchable component, said actuating component of said second tamper switch assembly located proximal to said switchable component.

2. The assembly of claim 1, said first movement-sensing switch being a magnetically actuatable switch operable to switch between said first and second separate movement-sensing states in response to a change in magnetic field conditions adjacent the first movement-sensing switch.

3. The assembly of claim 2, including a first switch actuating component mounted on said other member and operable, in response to relative movement between the first and second members, to alter the magnetic field conditions adjacent the first movement-sensing switch so as to cause movement between said first and second separate movement-sensing states.

4. The assembly of claim 1, said first movement-sensing switch including a housing, at least one elongated, electrically conductive switch element extending into said housing, a shiftable body located within said housing and formed of electrically conductive material, and a second electrically conductive switch element, said body shiftable within the housing between a first position wherein the body is in electrical contact with both said first and second switch elements, and a second position wherein the body is not in contact with both said first and second switch elements.

5. The assembly of claim 1, said actuating component operable, in response to relative shifting between the switchable component and actuating component, to alter the magnetic field conditions adjacent the switchable component so as to cause a switch between said first and second tamper-sensing states.

6. The assembly of claim 1, said mounting structure comprising a first plate supporting said first movement-sensing switch, a second plate supporting one of said components of said second tamper switch assembly, said first and second plates secured to said one member.

7. The assembly of claim 6, there being threaded fasteners attaching said first and second plates to said one member.

8. The assembly of claim 6, said first switch and second switch assembly cooperatively configured such that detachment of the first or second plate, or both thereof, causes said relative shifting movement between said switchable component and said actuating component.

9. The assembly of claim 6, said second plate supporting said switchable component of said second tamper switch.

10. The assembly of claim 9, said first plate supporting said actuating component of said second tamper switch assembly.

11. The assembly of claim 6, said first plate secured to said one member by a first threaded fastener, said second plate secured to said one member by a second threaded fastener, said first plate being detachable from the first member separately from the second plate.

12. The assembly of claim 11, said second plate including an elongated arm extending from said second threaded fastener and having said tamper switch component supported thereon spaced laterally from the second threaded fastener such that detachment of the second threaded fastener will cause the second plate and switch component supported thereon to shift relative to the other component of the tamper switch.

13. The assembly of claim 1, said mounting structure comprising a single plate supporting said first switch and second switch assembly, there being a positioning element supported on the single plate and operable to hold one of the components of said tamper switch assembly in a first position corresponding to one of said tamper-sensing states, detachment of said single plate causing movement of said positioning element resulting in switching of the switchable component to the other of said tamper-sensing states.

14. The assembly of claim 13, said positioning element supporting said actuating component of said tamper switch assembly.

15. The assembly of claim 13, said positioning element comprising a threaded fastener extending through said single plate.

16. The assembly of claim 1, said first switch and one of the components of said second switch assembly supported together in a single enclosure, the other component of said second switch assembly supported adjacent said single enclosure.

17. The assembly of claim 16, said one component of said second switch assembly being said actuating component.

18. The assembly of claim 16, said other component of said second switch assembly supported on a housing, said enclosure received within said housing.

19. The assembly of claim 18, including a threaded fastener extending through said enclosure and received within a threaded opening of said housing.

20. The assembly of claim 18, said other component being said actuating component.

21. The assembly of claim 1, said second tamper switch switchable component selected from the group consisting of a reed switch, Hall effect switch, micro switch, a magnetic side switch, and magnetic ball switch.

22. The assembly of claim 16, said one component of said second switch assembly being said switchable component of said tamper-sensing switch assembly, and said other component being said actuating component of said tamper-sensing switch assembly.

23. The assembly of claim 22, including a bushing located within said hollow space of said one member and receiving said first switch and said switchable component of said tamper-sensing switch assembly, said actuating component of said tamper-sensing switch assembly being secured to said bushing.

24. The assembly of claim 1, said one member being formed of metal.

25. The assembly of claim 1, said one member being formed of wood.

26. The assembly of claim 1, said one member being a door frame, and said other member being a door.

27. A tamper-resistant switch assembly operable to detect relative movement between first and second members, comprising:

a first movement-sensing switch mounted on one of said members and operable to switch between first and second separate movement-sensing states in response to relative movement between said first and second members;

a second tamper-sensing switch assembly mounted on said one member and including a switchable component and an actuating component, said switchable component and actuating component being relatively shiftable, said switchable component switchable between first and second tamper-sensing states in response to said relative shifting between the switchable and actuating components; and mounting structure operable to attach said first switch and second switch assembly to said one member in a normal operating position wherein said first switch will sense said relative movement between said first and second members, and to cause said relative shifting between the switchable component and the actuating component of said tamper switch assembly, in the event of attempted detachment of at least one of the components of said second switch assembly, the first switch, or both thereof, from said normal operating position, said mounting structure comprising a first plate supporting said first movement-sensing switch, a second plate supporting one of said components of said second tamper switch assembly, said first and second plates secured to said one member, said first plate secured to said one member by a first threaded fastener, said second plate secured to said one member by a second threaded fastener, said first plate being detachable from the first member separately from the second plate, said second plate including an elongated arm extending from said second threaded fastener and having said tamper switch component supported thereon spaced laterally from the second threaded fastener such that detachment of the second threaded fastener will cause the second plate and switch component supported thereon to shift relative to the other component of the tamper switch.

28. A tamper-resistant switch assembly operable to detect relative movement between first and second members, comprising:

a first movement-sensing switch mounted on one of said members and operable to switch between first and second separate movement-sensing states in response to relative movement between said first and second members;

a second tamper-sensing switch assembly mounted on said one member and including a switchable component and an actuating component, said switchable component and actuating component being relatively shiftable, said switchable component switchable between first and second tamper-sensing states in response to said relative shifting between the switchable and actuating components; and mounting structure operable to attach said first switch and second switch assembly to said one member in a normal operating position wherein said first switch will sense said relative movement between said first and second members, and to cause said relative shifting between the switchable component and the actuating component of said tamper switch assembly, in the event of attempted detachment of at least one of the components of said second switch assembly, the first switch, or both thereof, from said normal operating position, said first switch and one of the components of said second switch assembly supported together in a single enclosure, the other component of said second switch assembly supported adjacent said single enclosure, said one component of said second switch assembly being said actuating component.

29. A tamper-resistant switch assembly operable to detect relative movement between first and second members, one of said members having an apertured outer surface and a hollow interior space inboard of said outer surface and in communication with said aperture, said switch assembly comprising:

a first movement-sensing switch located within said hollow interior space of said one member inboard of said outer surface and operable to switch between first and second separate movement-sensing states in response to relative movement between said first and second members;

a second tamper-sensing switch assembly located within said hollow interior space of said one member inboard of said outer surface and including a switchable component and an actuating component, said switchable component and actuating component being relatively shiftable, said switchable component switchable between first and second tamper-sensing states in response to said relative shifting between the switchable and actuating components; and mounting structure operable to support said first switch and second switch assembly within said hollow interior space of said one member and inboard of said outer surface thereof in a normal operating position wherein said first switch will sense said relative movement between said first and second members, and to cause said relative shifting between the switchable component and the actuating component of said tamper switch assembly, in the event of attempted detachment of at least one of the components of said second switch assembly, the first switch, or both thereof, from said normal operating position, said mounting structure comprising a first plate supporting said first movement-sensing switch, a second plate supporting one of said components of said second tamper switch assembly, said first and second plates secured to said one member said second plate supporting said switchable component of said second tamper switch, said first plate supporting said actuating component of said second tamper switch assembly.

30. A tamper-resistant switch assembly operable to detect relative movement between first and second members, one of said members having an apertured outer surface and a hollow interior space inboard of said outer surface and in communication with said aperture, said switch assembly comprising:

a first movement-sensing switch located within said hollow interior space of said one member inboard of said outer surface and operable to switch between first and second separate movement-sensing states in response to relative movement between said first and second members;

a second tamper-sensing switch assembly located within said hollow interior space of said one member inboard of said outer surface and including a switchable component and an actuating component, said switchable component and actuating component being relatively shiftable, said switchable component switchable between first and second tamper-sensing states in response to said relative shifting between the switchable and actuating components; and mounting structure operable to support said first switch and second switch assembly within said hollow interior space of said one member and inboard of said outer surface thereof in a normal operating position wherein said first switch will sense said relative movement between said first and second members, and to cause said relative shifting between the switchable component and the actuating component of said tamper switch assembly, in the event of attempted detachment of at least one of the components of said second switch assembly, the first switch, or both thereof, from said normal operating position, said mounting structure comprising a first plate supporting said first movement-sensing switch, a second plate supporting one of said components of said second tamper switch assembly, said first and second plates secured to said one member, said first plate secured to said one member by a first threaded fastener, said second plate secured to said one member by a second threaded fastener, said first plate being detachable from the first member separately from the second plate, said second plate including an elongated arm extending from said second threaded fastener and having said tamper switch component supported thereon spaced laterally from the second threaded fastener such that detachment of the second threaded fastener will cause the second plate and switch component supported thereon to shift relative to the other component of the tamper switch.

31. A tamper-resistant switch assembly operable to detect relative movement between first and second members, one of said members having an apertured outer surface and a hollow interior space inboard of said outer surface and in communication with said aperture, said switch assembly comprising:

a first movement-sensing switch located within said hollow interior space of said one member inboard of said outer surface and operable to switch between first and second separate movement-sensing states in response to relative movement between said first and second members;

a second tamper-sensing switch assembly located within said hollow interior space of said one member inboard of said outer surface and including a switchable component and an actuating component, said switchable component and actuating component being relatively shiftable, said switchable component switchable between first and second tamper-sensing states in response to said relative shifting between the switchable and actuating components; and mounting structure operable to support said first switch and second switch assembly within said hollow interior space of said one member and inboard of said outer surface thereof in a normal operating position wherein said first switch will sense said relative movement between said first and second members, and to cause said relative shifting between the switchable component and the actuating component of said tamper switch assembly, in the event of attempted detachment of at least one of the components of said second switch assembly, the first switch, or both thereof, from said normal operating position, said first switch and one of the components of said second switch assembly supported together in a single enclosure, the other component of said second switch assembly supported adjacent said single enclosure, said one component of said second switch assembly being said actuating component.

32. A tamper-resistant switch assembly operable to detect relative movement between first and second members, one of said members having an apertured outer surface and a hollow interior space inboard of said outer surface and in communication with said aperture, said switch assembly comprising:

a first movement-sensing switch located within said hollow interior space of said one member inboard of said outer surface and operable to switch between first and second separate movement-sensing states in response to relative movement between said first and second members;

a second tamper-sensing switch assembly located within said hollow interior space of said one member inboard of said outer surface and including a switchable component and an actuating component, said switchable component and actuating component being relatively shiftable, said switchable component switchable between first and second tamper-sensing states in response to said relative shifting between the switchable and actuating components; and mounting structure operable to support said first switch and second switch assembly within said hollow interior space of said one member and inboard of said outer surface thereof in a normal operating position wherein said first switch will sense said relative movement between said first and second members, and to cause said relative shifting between the switchable component and the actuating component of said tamper switch assembly, in the event of attempted detachment of at least one of the components of said second switch assembly, the first switch, or both thereof, from said normal operating position, said first switch and one of the components of said second switch assembly supported together in a single enclosure, the other component of said second switch assembly supported adjacent said single enclosure, said one component of said second switch assembly being said switchable component of said tamper-sensing switch assembly, and said other component being said actuating component of said tamper-sensing switch assembly, including a bushing located within said hollow space of said one member and receiving said first switch and said switchable component of said tamper-sensing switch assembly, said actuating component of said tamper-sensing switch assembly being secured to said bushing.

33. A tamper-resistant switch assembly operable to detect relative movement between first and second members, one of said members having an apertured outer surface and a hollow interior space inboard of said outer surface and in communication with said aperture, said switch assembly comprising:

a first movement-sensing switch located within said hollow interior space of said one member inboard of said outer surface and operable to switch between first and second separate movement-sensing states in response to relative movement between said first and second members;

a second tamper-sensing switch assembly located within said hollow interior space of said one member inboard of said outer surface and including a switchable component and an actuating component, said switchable component and actuating component being relatively shiftable, said switchable component switchable between first and second tamper-sensing states in response to said relative shifting between the switchable and actuating components; and mounting structure operable to support said first switch and second switch assembly within said hollow interior space of said one member and inboard of said outer surface thereof in a normal operating position wherein said first switch will sense said relative movement between said first and second members, and to cause said relative shifting between the switchable component and the actuating component of said tamper switch assembly, in the event of attempted detachment of at least one of the components of said second switch assembly, the first switch, or both thereof, from said normal operating position, said one member being a door frame, and said other member being a door.

* * * * *